United States Patent [19]

Burkett

[11] Patent Number: 4,630,453

[45] Date of Patent: Dec. 23, 1986

[54] APPARATUS AND METHOD FOR SECURELY FASTENING VARIOUS PIERCED EARRING POSTS

[76] Inventor: Cullen L. Burkett, 515 Robin Dr., Seneca, S.C. 29678

[21] Appl. No.: 746,646

[22] Filed: Jun. 20, 1985

[51] Int. Cl.[4] ..... A44C 7/00

[52] U.S. Cl. ..... 63/12; 24/155 R; 24/664; 24/155 BB

[58] Field of Search ..... 63/12, 13; 24/155 R, 24/155 BB, 155 SD, 155 T, 662, 664

[56] References Cited

U.S. PATENT DOCUMENTS 183,164 10/1876 Hessels ..... 63/12 X
1,005,283 10/1911 Neher ..... 24/155 R
2,552,151 5/1951 Cohen ..... 63/12
2,667,675 2/1954 Brutti ..... 24/155 BB

FOREIGN PATENT DOCUMENTS 3009607 9/1981 Fed. Rep. of Germany ..... 63/12

*Primary Examiner*—F. Barry Shay

[57] ABSTRACT

An apparatus for gripping various types of earring posts having a friction clutch incorporated with a finger-operated clutch-catch capable of providing a positive stop to a specially designed indented shoulder post as well as providing a semi-positive stop to conventional threaded and indented shoulder posts. The friction clutch acts as a backup securing device if the primary clutch-catch fails.

4 Claims, 7 Drawing Figures

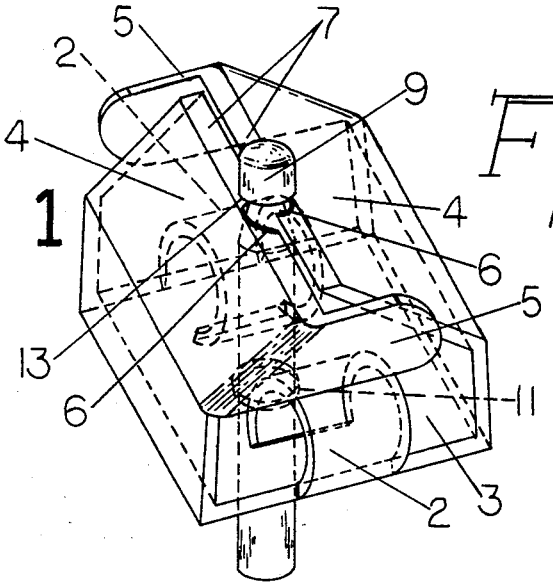
Fig. 1
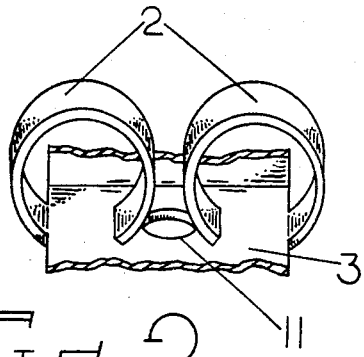
Fig. 2
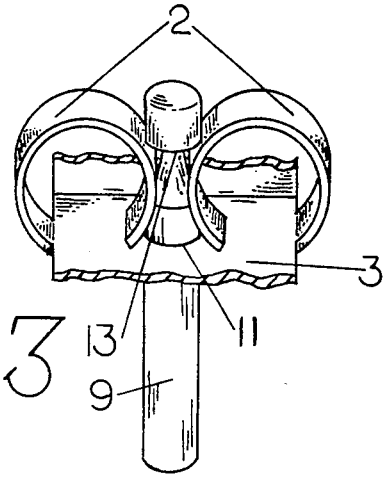
Fig. 3
Fig. 4
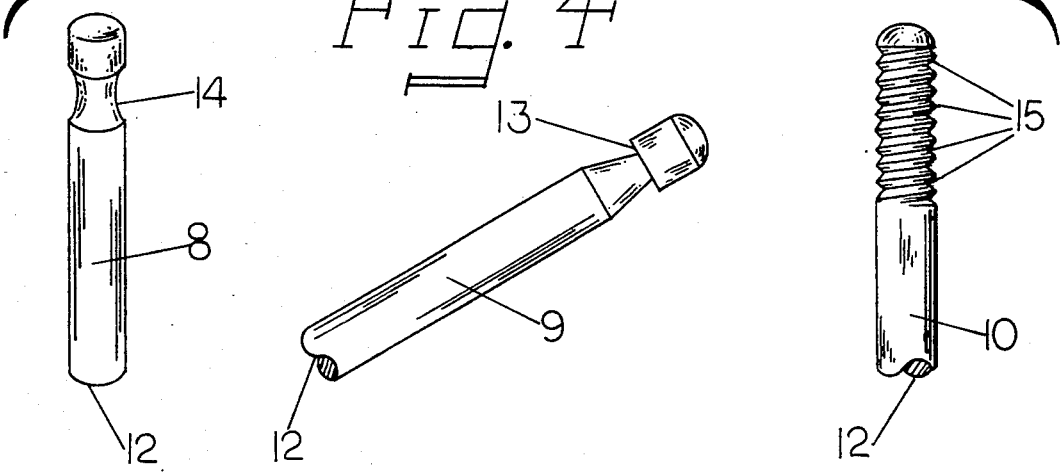

APPARATUS AND METHOD FOR SECURELY FASTENING VARIOUS PIERCED EARRING POSTS

BACKGROUND OF THE INVENTION

1. Field of the Invention

The present invention generally relates to post type pierced earring fasteners and more particularly to positive stop fasteners having a backup fastening means while also having fastening capability to earrings fitted with the following type posts: (1) conventional indented shoulder posts; (2) conventional threaded posts; and (3) a post with an indented shoulder of such design as to be positively held in the fastener.

2. Description of the Prior Art

The securing of post type earrings to the wearer's ears has become more important because more people are buying expensive earrings. Many earrings are also being lost annually, therefore costing consumers and insurance companies millions of dollars.

Most of the lost earrings were equipped with an indented shoulder post and a friction clutch. Several million pairs of expensive earrings with this type post are either already in the hands of consumers or in various stages of manufacturing or marketing. These earrings need additional security provided for them.

Attempts to make better friction clutches for use on indented shoulder posts has entailed making the clutch curls of slightly different shape or making the entire clutch heavier. The indention of the posts has also been made deeper, but none of these methods has satisfactorily prevented loss of earrings.

Complete changes in the type clutch used on conventional indented posts have been tried with little success in preventing loss. One such clutch constitutes a cylinder of rubber with a hole smaller in diameter than the post drilled through the axis. The cylinder of rubber is also encased in metal around the circumference leaving the hole exposed on at least one end. The rubber's gripping ability is reduced greatly when body oil residues from the ear hole make the posts slippery. Another type clutch is merely a modified tie tac clutch which tends to scrape the posts.

Other attempts to add security have involved changing the entire posts. The threaded post is one example of a completely different post. A threaded nut holds this post in the ear. It takes considerably more time to attach these nuts than other type fasteners. Also, the threads irritate the ear hole and provide a hiding place for bacteria. The threads eventually wear, causing the nuts to loosen and fall off the posts. Several push-on and thread-off nuts have been designed for use on the threaded posts. These nuts are easier to fasten, but their removal is slow and they damage the post threads sooner than conventional threaded nuts.

Still another attempt at adding security is the new "La Poussette" tm catch and post system. The catch offers a positive stop, but must be used with its specially designed post. It incorporates only one post gripping means. The post is worn almost completely extended on the back side of the ear, bringing some risk of injury. Also, the removal mechanism fits tightly against the ear making removal difficult, especially by older or arthritic fingers.

Designing a fastener that offers an absolute positive stop when used on conventional indented shoulder posts has been shown in prior art to be a difficult, if not impossible, task to accomplish. A positive stop mechanism appears to require a specially designed post to accommodate the fastener. Since most present post type pierced earrings have either conventional indented shoulder posts or conventional threaded posts, it becomes apparent that a fastener is needed that will offer additional security to these posts as well as offer a positive stop when used with a specially designed post.

Marketing such a fastener would be simple because the earring owner would simply purchase the catches and slip them on the earring posts. The conventional posts could always be changed to the specially designed posts later, if the owner felt the additional security was needed.

SUMMARY OF THE INVENTION

The present invention provides a versatile post earring catch designed to satisfy the aforementioned needs. It works on three different types of earring posts: conventional threaded posts, conventional indented shoulder posts, and posts designed to be positively held in the apparatus. This catch offers two post gripping means, making it superior to conventional earring clutches. It's ease in operation makes it superior to threaded nuts and it's versatility with different types of posts makes it superior to other positive stop earring fasteners. Additionally, the invention's one-piece design makes it practical to manufacture.

Accordingly, the present invention relates to apparatus for securing post type pierced earrings. The one-piece design incorporates a conventional clutch with a finger operated clutch-catch. The invention offers a semi-positive stop catch when used with conventional threaded post or indented post earrings, and offers a positive stop when used with a specially designed post. Additionally, should the primary clutch-catch fail, the conventional clutch incorporated in this catch will continue to grip the posts.

BRIEF DESCRIPTION OF THE DRAWINGS

FIG. 1 is a pictorial isometric view of a preferred embodiment of the post earring catch with the specially designed post held in position.

FIG. 2 is a pictorial isometric view of the clutch mechanism and base.

FIG. 3 is a pictorial isometric view of the clutch mechanism from FIG. 2 with a conventional indented shoulder post.

FIG. 4 is a side view of the three different posts which the catch is designed to fasten.

DESCRIPTION OF THE PREFERRED EMBODIMENT

Figure 5:
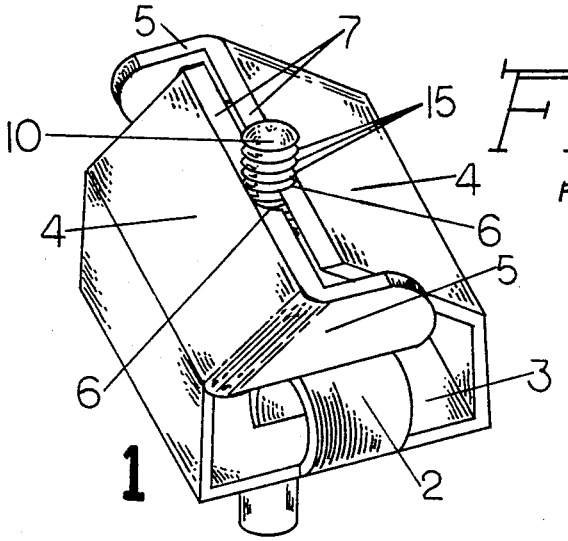
FIG. 5. is a pictorial isometric view as in FIG. 1 with a threaded post held in position.

Referring now to the drawings, and more particularly to FIG. 1, there is a pictorial isometric view of a preferred embodiment of the apparatus, generally designated 1, for securing various types of pierced earring posts to the ear. The preferred embodiment consists of a base 3 with a hole 11, a clutch mechanism, and a clutch-catch mechanism. The clutch mechanism, which can be more clearly understood in FIG. 2, consists of two curls integral to the base 3 curling upward, inward, downward, and then outward. The curls 2 almost touch each other at a point centered over the hole 11 in the base 3. The clutch-catch mechanism consists of two wings 4 integral to the base 3 rising upward and then inward over the clutch mechanism until they meet. The edges 7 of the wings 4 are sharpened and each edge 7 has a semi-circle-shaped indentation 6 offset from the other indentation. The wings 4 are also equipped with a finger tab 5 near the sharpened edge 7. The wings 4 are shaped to give space between the inside of the finger tab 5 and the outer sharpened corner of the edge 7 of the opposite wing 4. The length of this space should be equivalent to the length of the off-set between the indentations 6 in the edges 7.

Also shown in FIG. 1 is an example of a post 9 which may be positively held in the clutch-catch mechanism. The post 9, more clearly seen in FIG. 3 is inserted through the hole 11 in the base 3 forcing the clutch curls 2 apart. Referring again to FIG. 1, the curls 2 grip and guide the post tip to the area of the indented semi-circles 6 on the inside of the wings 4. Further pressure forces the wings 4 apart until the flattened shoulder 13 of the post 9 passes through the sharpened edges 7 allowing the wings 4 to come together forming an opening too small for the post shoulder 13 to be withdrawn through the indentations. Squeezing the finger tabs 5 together aligns the semi-circle indentations 6, forming a circle, thereby allowing the post shoulder 13 to be withdrawn.

It can be seen that the clutch curls 2 provide an additional stop for the shoulder 13 of the post 9, thereby providing additional safety if the clutchcatch mechanism fails. It can be further seen that the clutch-catch mechanism will also allow the post 9 to be inserted further than the shoulder 13, if desired, to allow earrings to be tightened on a thin ear lobe.

The shapes of the various type posts which are readily acceptable in the invention are shown in FIG. 4. The conventional indented shoulder post 8 has a concave indentation 14 around the circumference near the tip of the post. The specially designed indented shoulder post 9 has a flattened shoulder indentation 13 around the circumference near the tip of the post. The conventional threaded post 10 has common male threads 15 cut into the shaft for approximately half the length of the post. The opposite ends 12 of all posts may be fitted, usually by means of soldering, to various ear ornaments.

FIG. 5 shows the preferred embodiment 1 in its use with a conventional threaded post 10. It can be seen that the action of the clutch curls 2 on the threaded post 10 is basically the same as with the specially designed post 9. When the post 10 is inserted through the semi-circle indentations 6, the edges 7 of the wings 4 come together after thread 15 passes through, thereby providing a semi-positive stop to the post 10. Excessive wear to the threaded post 10 and the indentations 6 can be minimized by squeezing the tabs 5 during insertion of the post 10. If excessive pulling force is applied to the post 10, the wings 4 will be forced apart and/or the indentations 6 will be forceably aligned allowing the post 10 to be forceably removed, because of the angle of contact of the threads 15 to the sharpened edges 7 and the corners of the indentations 6. Normal post 10 removal is accomplished by squeezing the tabs 5.

Figure 6:
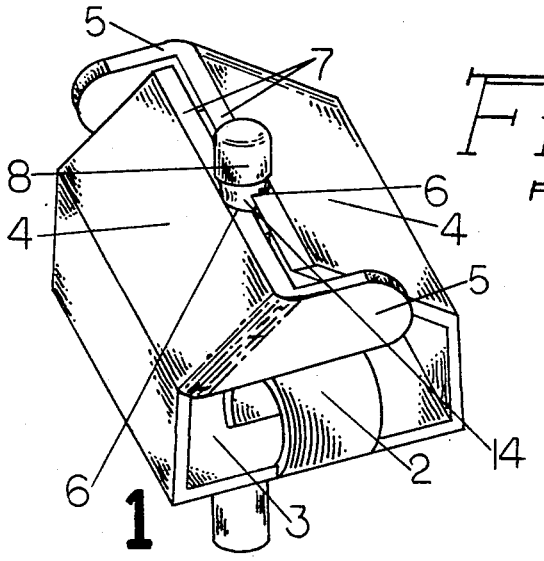
FIG. 6 is a pictorial isometric view as in FIG. 1 with a conventional indented shoulder post held in position.

The use of conventional indented shoulder posts 8 with the preferred embodiment 1 is shown in FIG. 6. The action of the clutch curls 2 is similar to its action on posts 9 and 10. When the post 8 is inserted through the indentations 6 in the edges 7 of the clutch-catch mechanism, the edges 7 close gradually in the posts indentation 14. This creates a semi-positive stop to the post 8. If excessive pulling force is applied to the post 8, the indented shoulder 14 will force the wings apart and/or forceably align the indentations 6 in the edges 7 of the wings 4, thereby allowing the post 8 to be forceably withdrawn from the catch. Normal post 8 removal is accomplished by squeezing the tabs 5.

Figure 7:
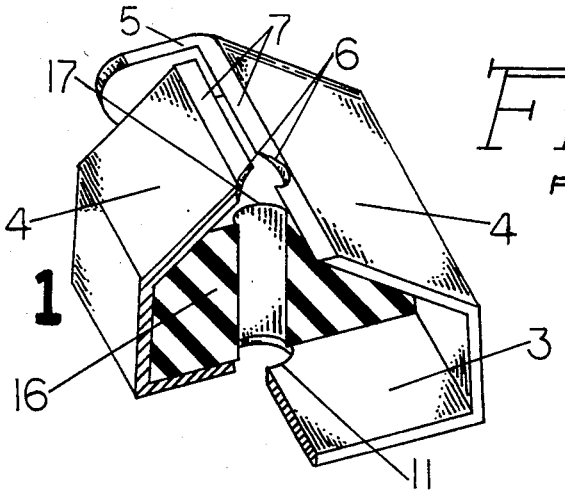
FIG. 7 is a cut-away pictorial isometric view of the catch with an alternative clutch mechanism.

While the use of the curl 2 clutch mechanism is preferred, other clutch mechanisms may be employed. One such clutch is shown in FIG. 7. It consists of a block of rubber 16 with a hole 17 drilled through it. The hole 17 is aligned with the hole 11 in the base 3 and the indentations 6 in the clutch-catch mechanism. The hole 17 should be slightly smaller in diameter than the posts used and the block of rubber 16 should be affixed to the mechanism by suitable means.

The preferred embodiment is made of 14K or 18K gold; however, other materials with suitable bending and springing properties may be used.

It is thought that the versatile posts type pierced earring catch apparatus and many of its attendant advantages will be understood from the foregoing description and it will be apparent that various changes may be made in the forms of construction and arrangement of the parts thereof without departing from the spirit and scope of the invention or sacrificing all of its material advantages, the form hereinbefore described being merely a preferred or exemplary embodiment thereof.

I claim:

1. An apparatus for securing threaded post earrings, conventional, indented shoulder post earrings, and earrings fitted with a specially designed post having a shoulder of such shape as to be positively held in the apparatus, comprising:

(a) a finger-releasable means for receiving and positively retaining any one of the ends of said specially designed post earrings, threaded post earrings and conventional indented shoulder post earrings, and;

(b) a clutch means for receiving, guiding, and retaining said one earring post end when the latter is received by said finger-releasable means, said clutch including means positioned to act as a back-up gripping device to an earring post which may become released from the primary finger-releasable means of said apparatus.

2. An apparatus for securing threaded post earrings, conventional indented shoulder post earrings, and earrings fitted with specially designed posts having a shoulder of such shape as to be positively held in the apparatus, comprising:

(a) a base with a hole;

(b) a clutch integral to said base, said clutch including means positioned to receive and retain the post of any of said earrings that is extended through said hole; and (c) a finger-releaseable clutch-catch integral to said base, said clutch-catch including means positioned to receive and retain the end portion of the post of any of said earrings which is extended through said clutch.

3. An apparatus as recited in claim 2, wherein the clutch is comprised of two narrow strips beginning at opposite sides of said base curling up and around forming a post-gripping region between the said curls in line with and between the hole in said base and the catching region of said clutch-catch.

4. An apparatus as recited in claim 2, wherein said clutch-catch comprises:

two wings integral to said base rising above and surrounding the clutch means on two sides and bent together to a meeting region in such a way as to apply pressure against each other or against a post inserted between said wings at said meeting region;

sharpened edges at said meeting region;

semi-circle indentations in said sharpened edges;

said indentations overlapping each other;

finger tabs integral to said wings; and sides of said wings of such shape as to allow said finger tabs to be squeezed thereby aligning said overlapping indentations forming a circular opening.

* * * * *